United States Patent [19]

Jones

[11] 4,073,302

[45] Feb. 14, 1978

[54] CLEANING APPARATUS FOR SEWER PIPES AND THE LIKE

[76] Inventor: Thomas E. Jones, 11689-74th Ave., Delta, B. C., Canada, V4C 1E6

[21] Appl. No.: 760,345

[22] Filed: Jan. 18, 1977

[51] Int. Cl.[2] ..... B08B 9/04

[52] U.S. Cl. ..... 134/167 C; 15/104.3 R

[58] Field of Search ..... 134/22 C, 24, 167 C, 134/168 C; 15/104.12, 104.19, 104.3 R

[56] References Cited

U.S. PATENT DOCUMENTS

| | | | |
|---|---|---|---|
| 1,132,691 | 3/1915 | Sieben | 15/104.3 R X |
| 2,089,597 | 8/1937 | Carter | 15/104.12 X |
| 2,887,118 | 5/1959 | Loeffler et al. | 134/168 C X |
| 3,525,112 | 8/1970 | Masters | 134/167 C X |

FOREIGN PATENT DOCUMENTS

| | | | |
|---|---|---|---|
| 1,298,764 | 6/1962 | France | 15/104.3 |
| 379,295 | 7/1973 | U.S.S.R. | 134/167 C |

*Primary Examiner*—Robert L. Bleutge

*Attorney, Agent, or Firm*—Fetherstonhaugh & Co.

[57] ABSTRACT

Apparatus for cleaning sewer and other pipes of accumulated debris has a nozzle on one end of a tubular body and a coupling on the opposite end of the body which enables the apparatus to be connected to a flexible hose leading to a source of pressurized water. A carriage assembly supports the body coaxially within the pipe and this assembly has wheels for primary engagement with the interior of the pipe and also longitudinally extending skids intended to contact the pipe interior should the wheels encounter an obstruction. The carriage assembly is radially adjustable and the nozzle has outwardly and rearwardly directed jets which discharge cleaning and propelling streams of high-pressure water.

1 Claim, 6 Drawing Figures

CLEANING APPARATUS FOR SEWER PIPES AND THE LIKE

This invention relates to apparatus which will facilitate the cleaning of underground pipes.

The hydraulic cleaning of sewer pipes and the like presents a number of problems when conventional equipment is used. Some of these problems are due to the fact the inner surfaces of the pipes often have damaged sections or obstructions which interfere with the free movement of the cleaning equipment. The equipment must include a nozzle for directing high-pressure water against the inner surface of the pipe and generally a skid or a wheeled carriage is provided to carry such a nozzle through the pipe during a cleaning operation. This nozzle-carrying portion of the equipment is sometimes halted by a small break in the pipe, or is hung up where a branch pipe enters the main pipe being cleaned. Furthermore, the nozzle is sometimes dragged through the pipe and is subjected to wear with the jets tending to become clogged with debris and the parts of the pipe furthest from the nozzle not being cleaned as effectively as they should be. The problems inherent in many pipe cleaning devices make it uneconomical to clean some sewer and other pipes, particularly those over b 12 inches in diameter.

The above mentioned as well as other disadvantages of known equipment are overcome by the present apparatus which can be adjusted to locate the nozzle exactly in the centre of pipes of varying diameter. An assembly which supports the nozzle in this manner is capable of clearing obstructions such as breaks in the pipe or branch-line openings so that its is unlikely the apparatus will ever become jammed or halted long enough to cause the flooding of a building connected to the main by the branch.

More specifically, apparatus for cleaning the interior of a pipe according to the present invention comprises a tubular body having rear and front ends, couplings means on the rear end for connecting the tubular body to a conduit leading to a source of cleaning fluid under high pressure, a nozzle on the front end, said nozzle having a front end wall and a plurality of jets arranged to discharge outwardly and rearwardly directed jet streams of the cleaning fluid to scour the interior of the pipe and create a forward-propelling reaction force, a carriage assembly mounted on the body for engagement with the interior of the pipe, and adjusting means for selectively positioning the carriage assembly radially of the tubular body whereby said tubular body is supported substantially in the centre of the pipe for travel therethrough.

Figure 1:
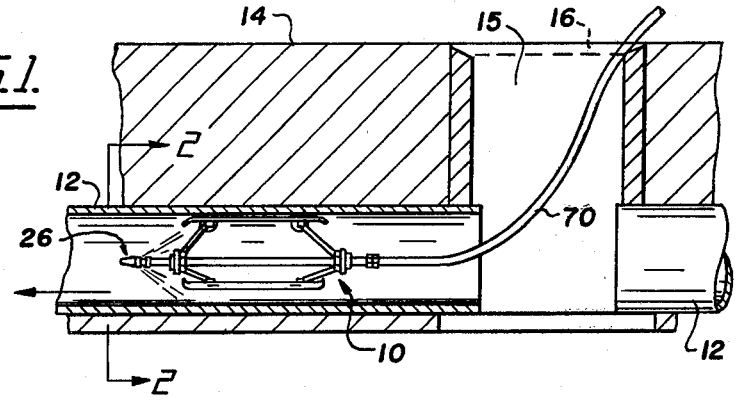
Figure 2:
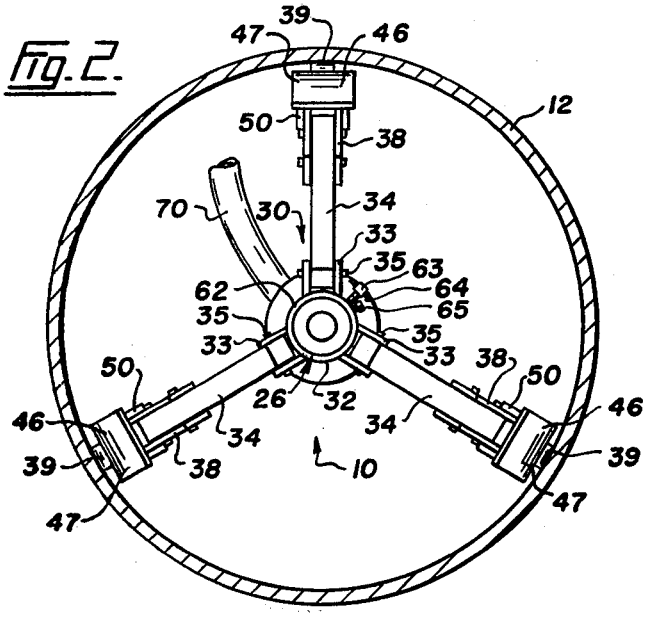
Figures 3, 4, 5, 6:
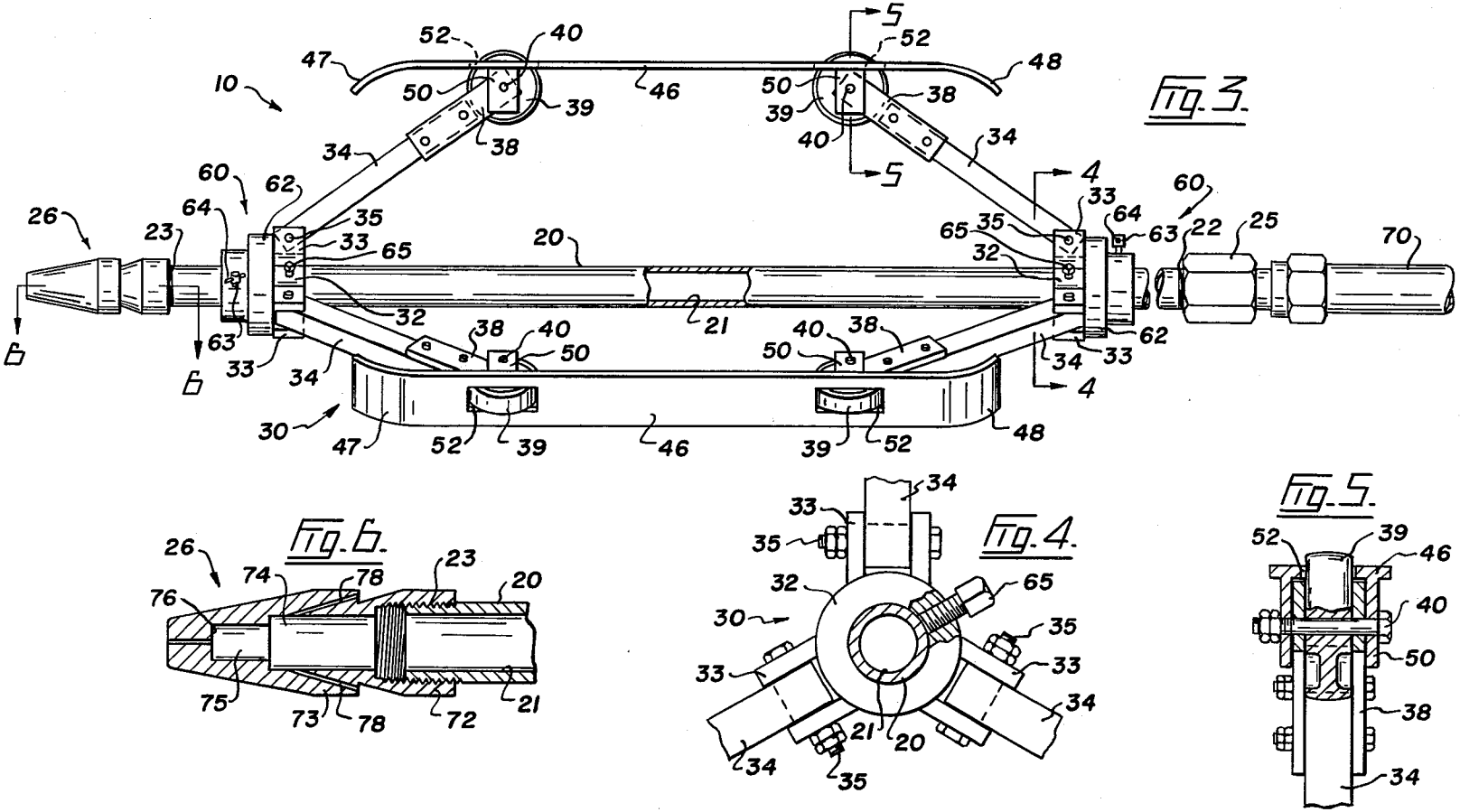

In drawings which illustrate a preferred embodiment of the invention,

FIG. 1 is a vertical section of a buried sewer pipe showing the present pipe cleaning apparatus in position of use;

FIG. 2 is an enlarged vertical section taken on the line 2—2 of FIG. 1, FIG. 3 is an enlarged side elevation of the present apparatus, FIG. 4 is a transverse section taken on the line 4—4 of FIG. 3, and FIG. 5 is a transverse section taken on the line 5—5 of FIG. 3, and FIG. 6 is a horizontal section taken on the line 6—6 of FIG. 3.

Referring to the drawings, the numeral 10 indicates generally pipe cleaning apparatus constructed in accordance with the present invention. In FIG. 1, the apparatus 10 is shown in a typical position of use during a cleaning operation in a sewer pipe 12 which is buried some distance below surface 14 of the ground. One end of the pipe 12 is shown open and accessible through a manhole 15 which normally is fitted with a removable cover 16.

Apparatus 10 comprises a body 20 which is shown best in FIG. 3 as being formed of a length of pipe having a bore 21 extending between threaded open ends 22 and 23. A hose coupling 25 is fitted to the rear end 22 and a nozzle 26 is secured to the opposite or front end 23.

The apparatus 10 includes a carriage assembly generally indicated at 30. Assembly 30 comprises a hub 32 which is slidably mounted on the body 20 near the rear end 22, the hub having radially projecting pairs of lugs 33 which are shown best in FIG. 4. A leg 34 is secured between each pair of lugs 33 by means of a transverse pivot bolt 35. The outer end of each leg (FIGS. 2 and 3 and particularly FIG. 5) is fitted with a fork 38 and a wheel 39 is journalled in this fork by means of an axle bolt 40 extending between the sides of the fork.

The carriage assembly 30 also includes a similar hub mounted on the body 20 near the front end 23 to support the same leg and wheel arrangement. The corresponding parts of the assembly near the nozzle 26 are identified by the same reference numerals used to designate the previously described assembly parts. In FIG. 2, the rearwardly inclined front legs 34 are shown spaced 120° apart about the circumference of the body. The forwardly inclined rear legs 34, of course, are similarly spaced apart so that the six legs of the carriage assembly are arranged as converging pairs of legs with each pair being fitted with a skid 46.

As shown best in FIGS. 3 and 5, the three identical skids 46 are formed of thin metal bars which are provided with upturned front and rear ends 47 and 48. Each skid has pairs of upstanding brackets 50 which straddle the forks 38 of front and rear legs, the axle bolts 40 projecting through these brackets to secure the skid to the legs. The skids 46, of course, are disposed parallel to the longitudinal axis of the body 20 and the construction of the assembly is such as to allow the skids to be swung towards and away from the body while remaining parallel thereto. In FIGS. 3 and 5, the skids will be seen to have rectangular slots 52 through which the wheels 39 project a short distance.

To allow the skids to be adjusted relative to the body, the apparatus 10 is provided with means generally indicated at 60 in FIG. 3. The adjusting means 60 is shown to comprise a pair of collars 62 which are slidably mounted on the body between the hubs and the ends of the body. Each collar 62 is fitted with a clamping bolt 63 which preferably is provided with a slidable lever 64. This arrangement allows the hubs to be locked in selected positions on the body. Desirably, the adjusting means 60 can also include other clamping bolts 65 which are fitted one to each of the front and rear hubs 32 so as to engage the body 20 as shown best in FIG. 4. Thus, when the bolts 63 and 65 of the rearmost hub and collar are loosened and the hub and collar are pushed forwardly on the body, the skids 46 are moved away from the body while remaining parallel thereto. Movement of the rearmost collar and hub in the opposite direction allows the skids 46 to move towards the body while maintaining their parallel relationship to the body. It will be noted that it is not essential to have the front hub and collar adjustably mounted on the body although it is desirable that they be so mounted.

The tubular body 20 is adapted to be connected to a length of hose 70 by means of the coupling 25. When the apparatus is in use, this hose extends to a source (not shown) of high pressure water or other cleaning fluid which is fed through the tubular body to discharge fron the nozzle 26.

Nozzle 26 is shown best in FIG. 6 to have a flange coupling 72 and an inwardly tapering front end portion 73. The coupling 72 is internally threaded to receive the front end 23 of the body. Within the portion 73, there is a large chamber 74 and a relatively small chamber 75 both communicating directly with the bore 21 of the body. Chamber 75 is substantially closed at the forward end of the nozzle by an end wall 76. The nozzle 26 is provided with a plurality of jets 78 which extend into the chamber 74, the jets being circumferentially spaced apart and disposed at an acute angle to the longitudinal axis of the body. Jets 78 are directed rearwardly to discharge high-pressure streams of water against the interior of the sewer pipe.

In use, a workman takes the sewer cleaning apparatus 10 down into the manhole 15 and places it in the open end of the sewer pipe 12 which is to be cleaned. The carriage assembly 30 is adjusted radially of the body 20 by use of the means 60 so that the wheels 39 are in firm contact with the inner surface of the pipe when the tubular body is centered in the pipe. The hose 70 is then connected to the tubular body by means of the coupling 25 whereupon the workman retreats from the manhole. Water pressure is turned on to discharge from the nozzle 26 and initially to clean the entrance end of the pipe. The force of the high-pressure water striking the end wall 76 of the nozzle plus the reaction of the powerful jets streams drives the apparatus forward and suitable tension is maintained on the hose 70 so that the device will move through the pipe at a suitable speed. The jet streams of water clean and scour the interior of the pipe as the self-propelled apparatus moves foward eventually to reach the opposite end of the pipe whereupon it is brought to a halt by means of the hose 70. The hose 70 is then wound in to clean the pipe during the return trip of the apparatus.

Very often obstructions will be encountered in the pipe such as joints or even ruptures in the pipe. The wheels 39 may encounter such an obstruction and normally this would have meant that the apparatus would jam in the sewer pipe. However, the skids 46 then move into sliding contact with the interior of the pipe and tend to ride over any obstructions encountered and thereby lift the wheels clear so that the present apparatus can travel back and forth through the pipe without fear of being hung up.

When the apparatus 10 is being transported from one cleaning operation to another, the carriage assembly 60 preferably is collapsed. One hub and collar is loosened on the body so that the skids can be moved into the close proximity with the body whereupon the overall diameter of the apparatus is reduced for convenient storage on a truck or elsewhere.

From the foregoing, it will be apparent the present apparatus is a simply and strudily constructed device which will operate to clean pipe which may have deteriorated somewhat since being installed. Such pipe often has breaks or other obstructions in the wall which normally could not be cleared by the wheels but the skids enable the apparatus to pass such obstructions as well as small branch pipes which may enter the main pipe. The nozzle is supported substantially in the center of the pipe so that maximum cleaning and forward propulsion is achieved. Furthermore, the nozzle is not subjected to wear which would otherwise occur if the nozzle was dragged along in sliding contact with the interior of the pipe as is done with some conventional cleaning equipment.

I claim:

1. Apparatus for cleaning the interior of a pipe comprising a tubular body having a smooth cylindrical bore and rear and front ends, coupling means on the rear end for connecting the tubular body to a conduit leading to a source of cleaning fluid under high pressure, a nozzle on the front end; said nozzle having a first cylindrical chamber of substantially the same diameter as the bore and a second cylindrical chamber of lesser diameter, a front end wall substantially closing one end of the second cylindrical chamber, and a plurality of jets communicating with the first chamber and arranged to discharge outwardly and rearwardly directed jet streams of the cleaning fluid to scour the interior of the pipe and create a forward-propelling reaction force; a carriage assembly including a pair of hubs mounted on the body, at least three legs pivotally secured at inner ends thereof to each hub, said legs being arranged on the pair of hubs as converging pairs of legs, a wheel rotatably mounted on an outer end of each leg for primary engagement with the interior of the pipe, a skid pivotally connected to outer ends of each converging pair of legs, said skids extending parallel to the longitudinal axis of the tubular body and intended for secondary engagement with the interior of the pipe, and means for adjusting at least one of the pair of hubs longitudinally of the tubular body whereby to position the skids a selected distance from said body and locate the nozzle centrally of the pipe.

* * * * *